United States Patent [19]

Parsons et al.

[11] 4,384,952

[45] May 24, 1983

[54] GRAIN CLEANING APPARATUS

[75] Inventors: Robert Parsons, Congerville; Robert Moser, Eureka, both of Ill.

[73] Assignee: Parsons Manufacturing, Incorporated, Roanoke, Ill.

[21] Appl. No.: 348,281

[22] Filed: Feb. 12, 1982

Related U.S. Application Data

[63] Continuation of Ser. No. 190,909, Sep. 24, 1980, abandoned.

[51] Int. Cl.[3] ..... B07B 1/04

[52] U.S. Cl. ..... 209/255; 209/356; 209/370

[58] Field of Search ..... 209/353–356, 209/240, 246, 253, 254, 255, 257, 281, 316, 317, 243, 370

[56] References Cited

U.S. PATENT DOCUMENTS

| | | | |
|---|---|---|---|
| 1,096,044 | 5/1914 | Lutz | 209/356 |
| 1,168,282 | 1/1916 | Burgeson | 209/370 |
| 1,229,033 | 6/1917 | Collins | 209/356 X |
| 2,080,977 | 5/1937 | Albrecht | 209/246 |
| 4,231,861 | 11/1980 | Hannie et al. | 209/240 |

OTHER PUBLICATIONS

Hunter Mfg., Inc., *Panda Scavenger For Grain Cleaning Efficiency* Brochure.

Clay Equipment Corp., *Modern Materials Handling Equipment.*

*Primary Examiner*—Ralph J. Hill

*Attorney, Agent, or Firm*—Wood, Dalton, Phillips, Mason & Rowe

[57] ABSTRACT

A grain cleaner having a plurality of cleaning sections radiating outwardly from a grain inlet. Each cleaning section has upper and lower downwardly sloped screens over which grain flows by gravity to sift out fine foreign material. Upper and lower foreign material chambers underlie respective screens, and external bypass ducts bypass foreign material from each upper chamber to an associated lower chamber of each cleaning section. Each lower foreign material receiving chamber communicates with a centrally located foreign material discharge outlet at the bottom of the cleaner.

6 Claims, 6 Drawing Figures

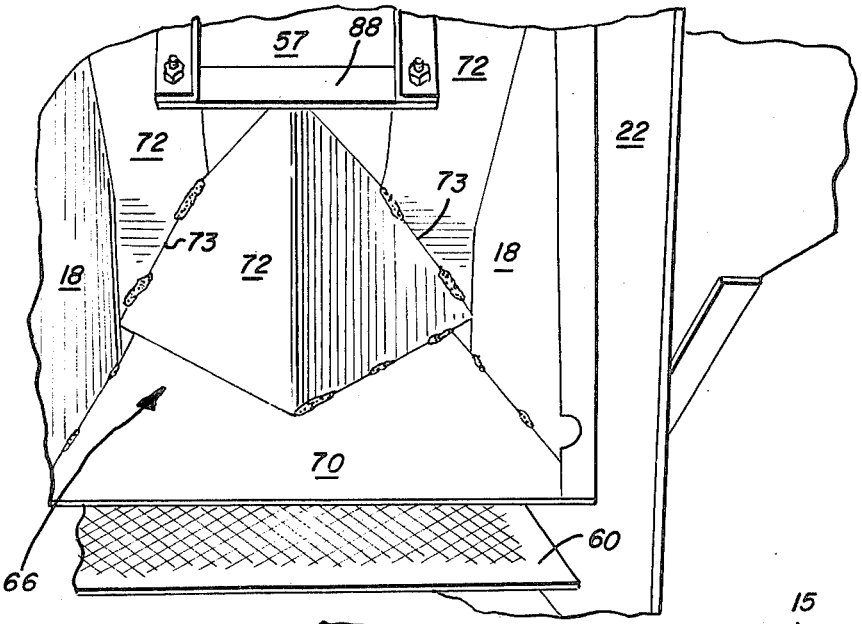
FIG. 4
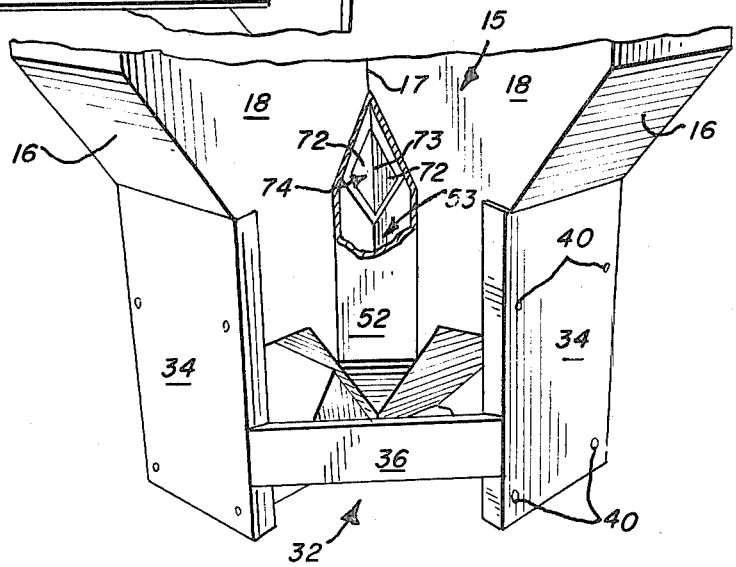
FIG. 5
FIG. 6
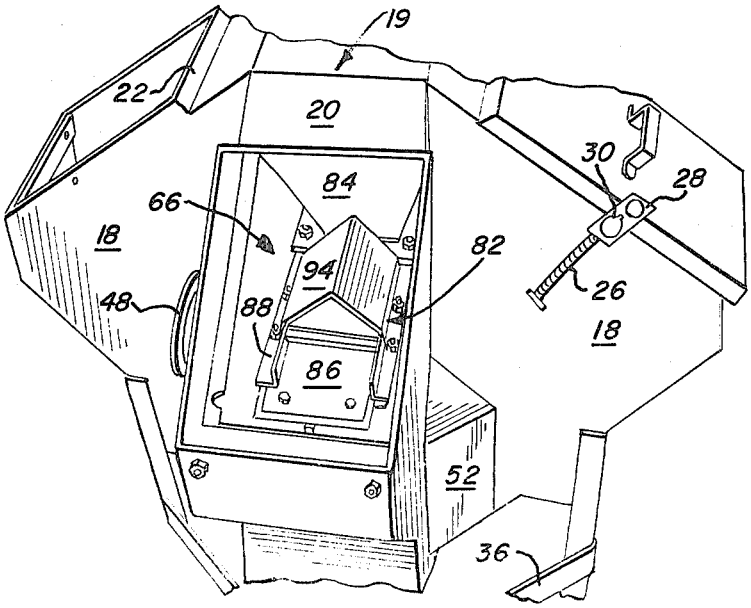

GRAIN CLEANING APPARATUS

This is a continuation of application Ser. No. 190,909 filed Sept. 24, 1980, now abandoned.

BACKGROUND OF THE INVENTION

1. Field of the Invention

This invention relates to a grain cleaning apparatus and, more particularly, this invention relates to a grain cleaning apparatus having a plurality of discrete cleaning sections with external ducts for bypassing foreign material around the grain flow path in each section.

2. Description of the Prior Art

In grain handling operations, it is frequently necessary to reduce the amount of relatively small foreign material, such as dust, chaff, etc., mixed with grain before storage or shipment thereof. For example, removal of foreign material from grain can increase the efficiency of grain dryers because moisture is typically preferentially absorbed by foreign material. Further, grain cleaning is desirable before storage because small foreign material tends to accumulate in the gaps between particles of stored grain to obstruct air flow through the grain from aeration systems.

Additionally, grain cleaning may be necessary to ensure that the maximum levels of foreign material permitted under the regulations of the Federal Inspection Grain Service Division of the U.S. Department of Agriculture are not exceeded. If the amount of foreign material in grain exceeds those levels, a shipment of grain is "docked" to result in a net loss of income to the shipper.

One form of grain cleaner which has achieved widespread acceptance utilizes gravity flow of grain over a series of screens within an upstanding housing. Grain flows through an inlet at the housing's upper end and is directed outwardly and downwardly over a first layer of screens. Relatively small particles of foreign material fall through the screens into a first foreign material chamber communicating with a foreign material outlet at the housing's lower end.

Grain reaching the outer periphery of the first level of screens reverses its direction of flow and is directed downwardly and inwardly over a second layer of screens overlying a second foreign material receiving chamber, also communicating with the foreign material outlet. Relatively clean grain is received at the bottom of the second level of screens and is directed to a clean grain outlet chute which communicates with a storage facility, vehicle or other grain receiving means.

Such a grain cleaner is typically an integral part of a continuous grain handling system, and may be disposed between a dry elevator leg and a grain storage tank, or between a wet elevator leg and a grain dryer, for example. If relatively clean grain, not requiring cleaning, is to be transferred through a system having a grain cleaner, it may be desirable to bypass the cleaner's screens by means of external lines or integral bypass means.

One form of grain cleaner of the type described above is generally in the shape of two back-to-back pyramids, where each pyramid is defined by four screens in the shape of truncated triangles. Screening occurs on four sides of the cleaner, thus permitting maximum screening to occur through a given vertical distance so as to minimize cleaner height. However, because the screens are in the shape of truncated triangles, corners along the wide side of the screens may be under-utilized.

Two forms of this type of cleaner are described in Hannie et al. U.S. patent application Ser. No. 24,057 filed Mar. 26, 1979, the details of which are hereby incorporated by reference. In the cleaners described in Hannie et al. application Ser. No. 24,057, foreign material is discharged from an upper chamber to a lower chamber through a chute at the bottom of the upper chamber which extends through one of the lower screen layers. In high throughput conditions, however, this chute is a significant obstruction in the second screen layer and thus hinders the flow of grain, thereby reducing capacity.

Other types of grain cleaners have been used in which only one or two sides are used for screening. Such cleaners have limited bushel per hour cleaning capacities since the screening area is relatively small, since screening is limited to, at most, two sides. If the length of the screens along the cleaning sides is increased to increase capacity, the overall height of the unit is correspondingly increased by as much as two feet or more.

Similarly, an increase in screen width to increase capacity results in a corresponding increase in cleaner width. A substantial increase in cleaner height or width is a disadvantage, since the space available in most elevator installations for grain cleaners is limited.

SUMMARY OF THE INVENTION

The present invention is directed to overcoming one or more of the problems as set forth above.

In one aspect of the present invention, a grain cleaner is provided having a plurality of cleaning sections radiating outwardly from a grain inlet. Each cleaning section has an upper and lower screen over which grain is passed to sift out foreign material. Foreign material chambers underlie each of the screens and external bypass ducts connect associated upper and lower chambers. The foreign material chambers in each cleaning section are contiguous with the chambers in adjacent sections. Foreign material from each upper foreign material chamber is bypassed around the lower screens to an associated lower foreign material chamber and to a centrally disposed foreign material discharge outlet.

The external bypass ducts allow a symmetrical construction with more than two, and preferably four, cleaning sides with a central foreign material discharge outlet. This symmetrical construction allows an increase in screening area over prior cleaners by virtue of an increase in the number of sides. Consequently, screening area is increased without a corresponding increase in height.

The grain cleaner of the invention may be easily and inexpensively constructed from a relatively small number of bent plates which are welded together.

Since the foreign material bypass ducts are located externally of the cleaning section, an obstruction-free grain flow path is provided.

In another aspect of the invention, an internal grain bypass chute and a grain proportioning gate are provided for bypass of a selected proportion of the grain around the cleaning sections. This chute separates bypassed grain from foreign material in the cleaning sections.

Other objects and advantages of the present invention will be apparent from the following detailed description and the accompanying drawings.

BRIEF DESCRIPTION OF THE DRAWINGS

FIG. 4 is a partial perspective view of the grain cleaner of FIGS. 1 and 2 taken from above with the upper screen of a cleaning section removed;

FIG. 5 is a partially broken perspective view of the lower portion of the grain cleaner of FIGS. 1 and 2 showing an external foreign material bypass duct; and FIG. 6 is a partial perspective view of the grain cleaner of FIGS. 1 and 2 showing a cleaning section with the flow belt removed to provide a view of a grain proportioning gate disposed therein.

DESCRIPTION OF THE PREFERRED EMBODIMENT

Figure 1:
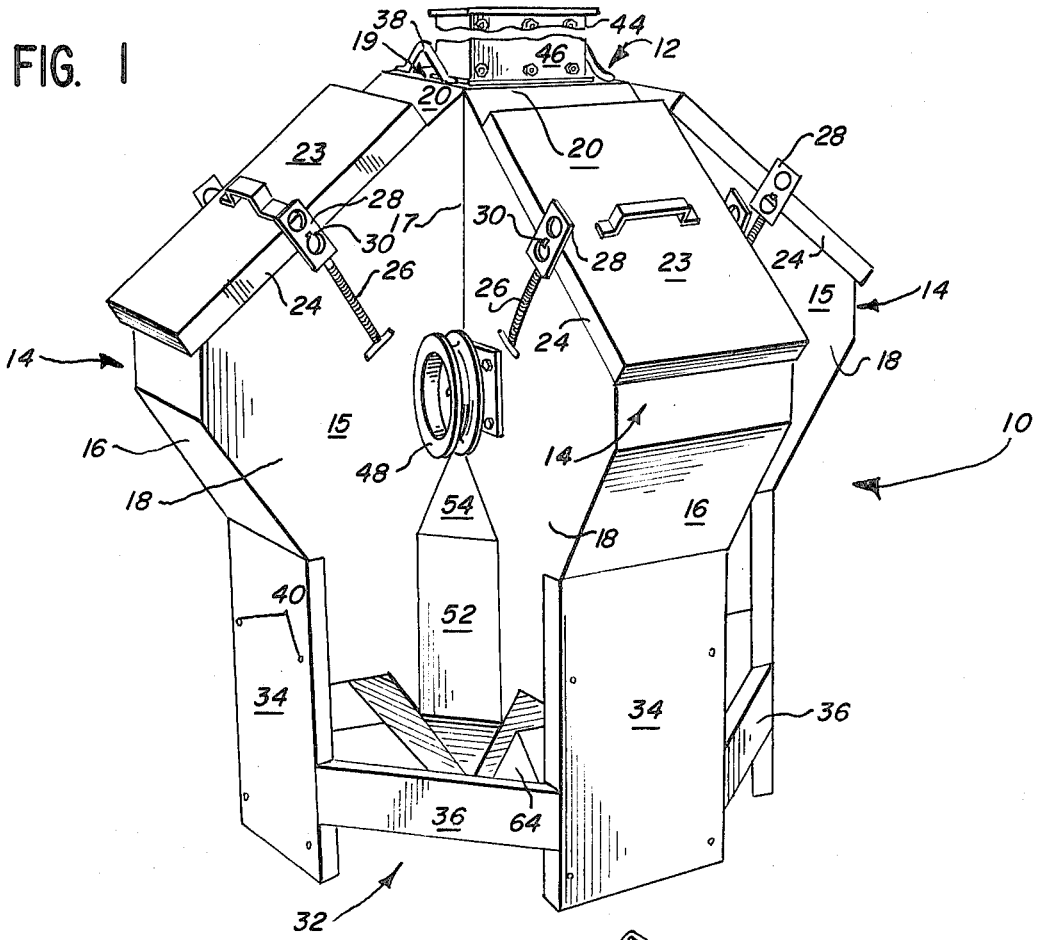
FIG. 1 is a perspective view of a grain cleaner made according to the invention.

An internal proportional bypass grain cleaner, generally designated 10, is illustrated in the Figures. The cleaner 10 has a central section 12 (best seen in FIGS. 2 and 3) from which a plurality of cleaning sections 14 radiate. In the embodiment shown, there are four cleaning sections 14.

A plurality of side wall panels 15 and end panels 16 define the outer surface of the cleaner 10. In the embodiment shown, there are four side wall panels 15, each panel 15 having a 90° bend 17 at its center line to form one side wall 18 of each of two adjoining cleaning sections 14. Four end panels 16 are secured to and extend between parallel side walls 18 to define the ends of each of the cleaning sections 14. The panels 15, 16 are secured together as by welding to provide a seal against weather and dust. The panels 15, 16 may comprise bent sheet metal, for ease and economy of construction.

A top cap 19 is provided over the center cleaner section 12. The top cap 19 has downwardly and outwardly extending flanges 20 fixed to and extending between the side wall panels 15 near their bends 17. An upper opening 21 and peripheral flange 22 are defined in each cleaning section 14 by the combination of the extensions on the sidewalls 15 with the upturned end of the flange 20 and the upper portion of the end panel 16.

A door 23 having a downwardly extending flange 24 matable with an associated flange 22, is provided for each cleaning section 14. Gaskets (not shown) on each door 23 ensure weather and dust sealing. The doors 23 are not hinged and thus may be lifted completely off the cleaner 10, providing ready access to the cleaner 10 for servicing. The doors 23 are retained on the cleaner 10 by springs 26. The lower end of each spring 26 is secured to a side wall panel 15 and the upper end of each spring 26 is attached to a clip 28 which slips over a projection 30 on a flange 24 on each side of the doors 23.

A mounting stand 32 has upstanding legs 34 and transverse supports 36 extending between the legs 34. The stand 32, which is permanently welded to the cleaner 10, supports the cleaner 10 in an operative position, such as above a grain storage tank. In addition, with the supports 36 disposed slightly above the bottom of the legs 34, the stand 32 lends itself to fork truck handling since a fork may be readily positioned under the supports 36. Two lifting eyes 38 are attached to the top cap 19 to facilitate the handling of the cleaner 10 by a crane.

Bolt holes 40 are provided in the stand legs 34, thus enabling a service platform (not shown) to be bolted thereto in an upper or lower position. Such a platform is desirable to permit servicing of the cleaner 10 since the cleaner 10 is typically mounted in an elevated position.

A vertical inlet spout 44 is welded to and extends upwardly from the top cap 19 for receipt of grain to be cleaned. The spout 44 is lined with a wear resistant material, such as ⅛" thick polyurethane, and has one removable side 46, which enables access to the spout 44 for servicing.

A proportioning valve control wheel 48 is mounted on a rack and pinion gate control shaft 50 journaled through one side wall panel 15. The wheel 48 controls a gate to selectively vary the proportion of grain diverted from the inlet spout 44 to the cleaning sections 14 as described below. Such an internal proportioning system is described in Hannie et al U.S. patent application Ser. No. 24,057, filed Mar. 26, 1979 and assigned to the assignee of this application. The radial configuration of the discrete cleaning sections 14 permits the wheel 48 to be located externally of the cleaner 10 for direct connection to an external control cable 51 (shown in FIG. 3).

Welded across each 90° corner bend 17 is a bypass plate 52 which defines a foreign material external bypass duct 53, for purposes detailed below. Triangular plate portions 54 at the top and bottom of each bypass plate 52 totally enclose the bypass ducts 53 within the cleaner 10.

Figure 2:
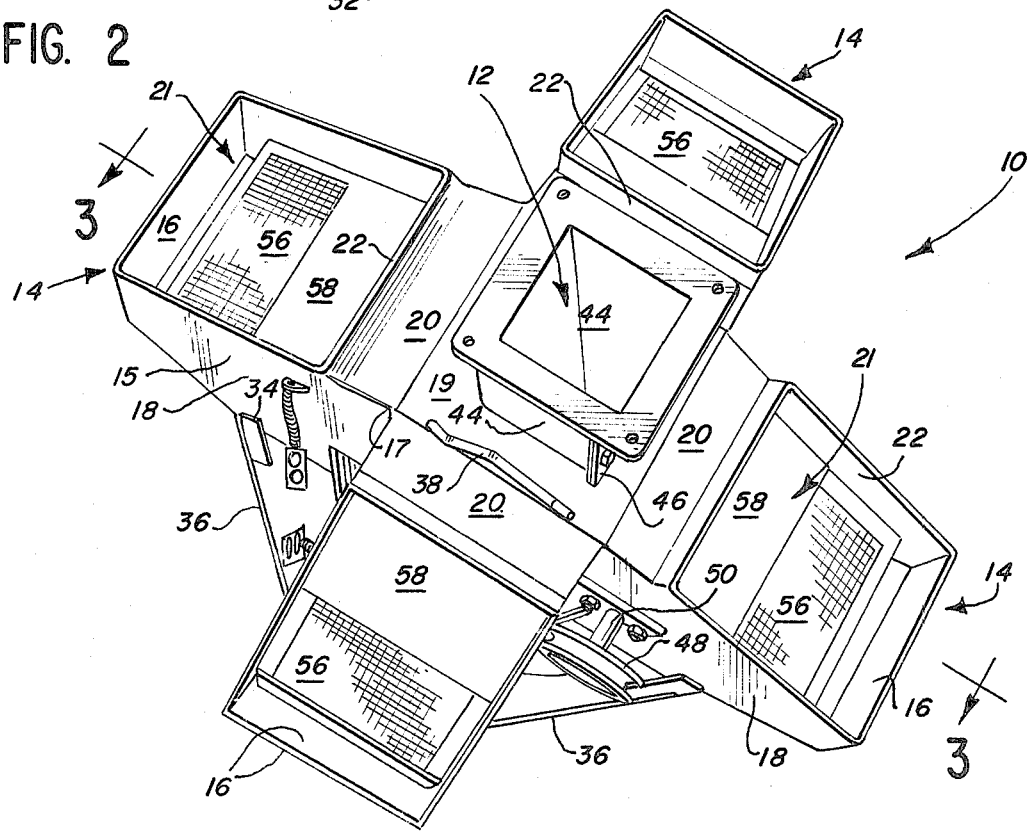
FIG. 2 is a perspective view of the grain cleaner of FIG. 1 taken from above with the access doors and lower screens removed from the cleaner's four cleaning sections.

As seen in FIG. 2, the doors 23 are removed to partially illustrate the interior of the cleaning sections 14. An upper rectangular screen 56 in each cleaning section 14 is inclined downwardly and outwardly from the central cleaner section 12. The screens 56 are supported so that they may be easily removed as by lifting, for cleaning or replacement. At their upper ends the screens 56 are in communication with the grain inlet spout 44 and a grain chute 57 extending downwardly from the screens 56 into the central cleaner section 12 (see FIG. 3). Flow belts 58 are suspended from vertically aligned flanges 59 around the top cap 19 to evenly distribute the flow of grain to the screens 56 in order to maximize the exposure of grain to the screens 56.

Lower rectangular screens 60 extend downwardly and inwardly toward the central cleaner section 12 from points on respective end panels 16 slightly below the lower end of the upper screens 56. The lower ends of screens 60 are open to a central grain receiving chamber 62 through which grain passes to reach a grain discharge spout 64 at the bottom of the cleaner 10. The discharge spout 64 is typically connected either to a grain storage tank or to a grain dryer for further processing.

Disposed beneath and partially defined by each of the upper and lower screens 56, 60 are upper and lower foreign material receiving chambers 66, 68 respectively. As grain passes over the screens 56, 60, fine foreign material such as dust and chaff passes through the screens 56, 60 and into the foreign material chambers 66, 68. The chambers 66, 68 are entirely separated from the grain flow path, as further detailed below.

Referring specifically to the upper foreign material chambers 66 (best seen in FIGS. 3 and 4), each chamber 66 is defined by an upper screen 56 and by wall means including an inclined wall 70 supported generally above the lower screen 60 and secured to the side wall panels 15 to seal the chamber 66 from the lower screen 60. The chambers 66 are open to one another at the central cleaner section 12.

At the bottom of each chamber 66 is surface 72 having the shape of an inverted V, with each side of the surface 72 being inclined downwardly toward the sides of the chamber 66. The V-shaped surfaces 72 abut one another in the central cleaner section 12 along lines 73 sloping downwardly from the corners of the grain chute 57 to the bends 17 in the side wall panels 15. The surfaces 72 accordingly direct foreign material to bottom corners at each side of the cleaning sections 14, where triangular discharge ports 72 (see FIGS. 3-5) are defined by openings in the side panels 15 at the 90° bends 17. The ports 74 communicate with the bypass ducts 53 exteriorly of the side wall panels 15.

The lower foreign material chambers 68 lie below and are partially defined by the lower screens 60. The bottom side of each chamber 68 is defined by the inner surface of an end panel 16. The chambers 68 open into a foreign material outlet chamber 76 in the central cleaner section 12. The grain discharge spout 64 extends through the foreign material outlet chamber 76.

Ports 78 (see FIGS. 3 and 5) are provided at the 90° bend 17 in each side wall panel 15 to place the lower end of an associated foreign material bypass duct 53 in communication with a lower foreign material chamber 68. Accordingly, the foreign material in the upper chambers 66 passes through the bypass ducts 53 to the lower foreign material chambers 68 and foreign material outlet chamber 76. From there, the foreign material falls through a foreign material discharge spout which is connected to the bottom center of the cleaner 10.

The configuration of the discrete cleaning sections 14 and rectangular screens 56, 60 as described above allows maximum utilization of the screen surface because the grain flow over the entire area of the screens 56, 60 is relatively uniform. Because cleaning sections 14 radiate from the entire perimeter of the central cleaner section 12, maximum screening area is obtained for any given cleaner height, since a plurality of cleaner sides are utilizable for cleaning. Thus, additional screening area is provided compared to prior discrete sided cleaners, without necessitating the lengthening of screens (which adds to cleaner height).

Further, the described configuration enables the bypass ducts 53 between foreign material chambers 66, 68 to be located externally of the cleaner so that grain flow over the screens 56, 60 is free of obstructions. Therefore, the bypass ducts 53 also have utility in grain cleaners which have external rather than internal grain chutes.

The preferred embodiment of the grain cleaner 10 has a variably positionable gate, generally designated 82, mounted below a valve box 84 at the top of the grain chute 57. The gate 82 comprises a plate 86 supported for horizontal movement within a frame 88. Suitable means are provided for interconnecting the control wheel 48 with the plate 86 so that movement of the plate 86 is effected by rotation of the wheel 48. The controlling cable 51 may be remotely driven, enabling the plate 86 to be moved by an operator located on the ground.

With knowledge of the foreign material content of incoming grain 92, the gate 82 may be selectively positioned to divert a selected proportion of incoming grain 92 away from the cleaning sections 14, thereby controlling the foreign material content of the grain leaving the grain outlet 64. Partial closing of the gate 82 limits the rate at which grain flows therethrough. When the rate of flow of incoming grain 92 is greater than the rate at which grain passes the gate 82, excess grain fills the valve box 84 and spills over into the cleaning sections 14. Thus, the rate at which grain flows through the cleaning sections 14 is equivalent to the difference between the flow rate of incoming grain 92 and the rate at which grain passes through the gate 82. This gate 82 is of the type described in Hannie et al U.S. patent application Ser. No. 24,057, filed Mar. 26, 1979, and further details may be obtained by reference to that application.

Figure 3:
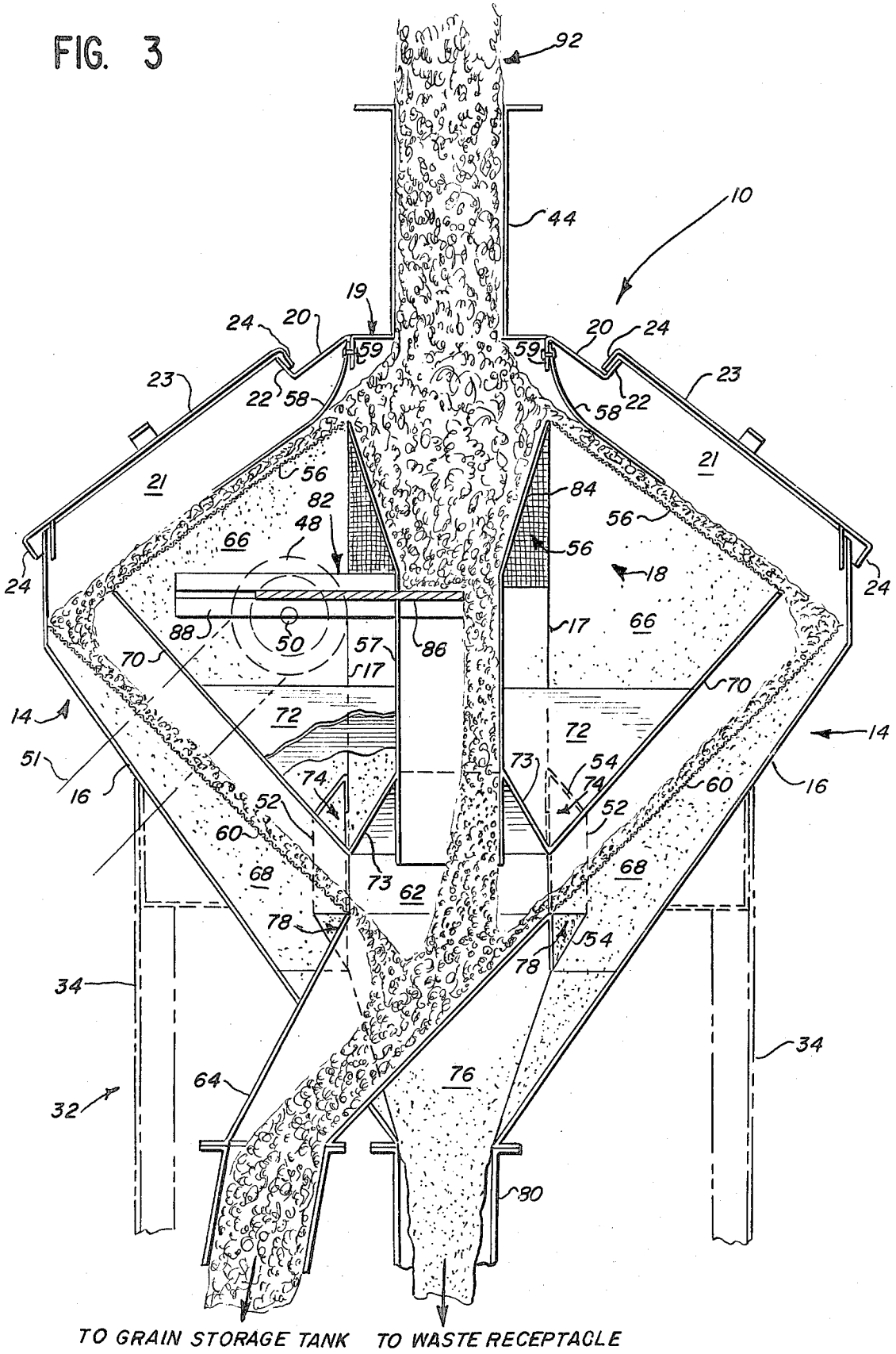
FIG. 3 is a vertical section of the grain cleaner of FIGS. 1 and 2, taken generally along line 3—3 of FIG. 2.

As can be seen in FIGS. 3 and 6, the gate 82 is located in the upper foreign material chamber 66 of one of the cleaning sections 14. In that chamber 66, an inverted V-shaped flow splitter 94 is located over the plate 86 to provide a function similar to that of the surfaces 72 in the other upper foreign material chambers 66. The flow splitter 94 protects the upper surface of the plate 86 from an accumulation of foreign material when the gate 82 is fully or partially closed.

Operation of the cleaner 10 may best be seen with reference to FIG. 3. When the gate is closed or partially closed, some of the grain is diverted to each of the cleaning sections 14. Grain thus moves down over the upper and lower screens 56, 60 and is discharged into the grain outlet chamber 62 where it is mixed with bypassed grain. Grain containing the desired amount of foreign material is then discharged through the discharge spout 64 to a desired receptacle such as a grain storage tank.

Fine foreign material in the grain passing over the screens 56, 60 falls through the screens 56, 60 and into the foreign material chambers 66, 68. Foreign material in the upper foreign material chambers 66 falls downwardly to the lower corners of the chambers 66. The foreign material then passes through the ports 74 to the bypass ducts 53. Foreign material from two adjacent corners of two separate upper foreign material chambers 66 falls through each duct 53 to the ports 78 which are open to the lower foreign material chambers 68. Foreign material from both the upper and lower chambers 66, 68 is thus guided to the foreign material outlet chamber 76 at the bottom of the cleaner 10 and is discharged through the foreign material discharge spout 80 to an appropriate waste receptacle.

While the grain cleaning apparatus 10 illustrated in the Figures has four cleaning sections 14, it will be appreciated that a grain cleaner may be constructed according to the invention with more or less than four cleaning sections. For example, in a grain cleaner having three cleaning sections 14, the sides 18 of adjacent sections 14 would intersect at an average angle of 120°.

The foregoing detailed description is given for clearness of understanding only, and no unnecessary limitations are to be inferred therefrom, as modifications will be obvious to those skilled in the art.

We claim:

1. A grain cleaning apparatus for removing fine foreign material from grain, comprising:

upstanding grain receiving means having an upper grain inlet;

a plurality of cleaning sections radiating outwardly from said grain receiving means and defined by a plurality of bent plate members, each of said bent plate members having a pair of panels joined at a bend, each of said panels defining a side of a cleaning section, and a plurality of end walls interconnecting said bent plate members, opposed pairs of panels of adjacent plate members cooperating with said end walls to define said cleaning sections;

screen means within each of said cleaning sections and defining a downwardly sloped cleaning path open at its upper end to said grain receiving means, said screen means supporting grain for gravity flow while foreign material passes therethrough and comprising at least a pair of upper and lower inclined screens;

an upper foreign material receiving chamber in each of said cleaning sections, each of said upper chambers being defined by one of said upper screens, the opposed inner surfaces of adjacent bent plate members, one of said end walls, and underlying walls in said cleaning sections, said underlying walls being generally sloped downwardly and having parts sloped toward said side plate members to define lower points in said upper chambers adjacent said bends in said bent plate members;

a lower foreign material receiving chamber in each of said cleaning sections, each of said lower chambers being defined by one of said lower screens, the opposed inner surfaces of adjacent bent plate members, and one of said end walls;

said bent plate members defining upper openings at the lower points in each of said upper chambers and lower openings communicating with said lower chambers;

a duct wall outwardly of and extending across the bend of each of said bent plate members, each of said duct walls enclosing an upper one and a lower one of said openings to place said upper chambers in communication with said lower chambers through a foreign material bypass duct defined by said bent plate members and said duct walls;

a foreign material discharge outlet communicating with each of said lower chambers; and a clean grain discharge outlet communicating with said screen means.

2. The grain cleaning apparatus of claim 1 further comprising a central vertical grain bypass chute in said grain receiving means between the adjacent inner portions of said radiating cleaning sections, said grain bypass chute interconnecting said upper grain inlet with said clean grain discharge outlet and being closed to said upper chambers.

3. The grain cleaning apparatus of claim 2 further comprising means for selectively diverting a portion of incoming grain from said grain bypass chute to said cleaning sections.

4. The grain cleaning apparatus of claim 1 wherein each of said duct walls comprises a flat plate.

5. The grain cleaning apparatus of claim 1 wherein there are at least three of said cleaning sections and the angles defined by said bends are substantially identical, each of said angles being no more than about 120°.

6. The grain cleaning apparatus of claim 1 wherein there are four of said cleaning sections and said bends define substantially right angles.

* * * * *